United States Patent [19]

Atkinson

[11] 4,425,830

[45] Jan. 17, 1984

[54] ANTI-KICKBACK SAW CHAIN

[75] Inventor: Renwick S. Atkinson, Portland, Oreg.

[73] Assignee: Carlton Company, Portland, Oreg.

[21] Appl. No.: 301,840

[22] Filed: Sep. 14, 1981

[51] Int. Cl.[3] ..... B27B 33/14

[52] U.S. Cl. ..... 83/833; 83/834

[58] Field of Search ..... 83/830, 831, 832, 833, 83/834

[56] References Cited

U.S. PATENT DOCUMENTS

| | | | |
|---|---|---|---|
| 1,150,218 | 8/1915 | Martin | 83/833 |
| 3,625,266 | 12/1971 | Kennemore | 83/830 |
| 4,353,277 | 10/1982 | Silvon | 83/833 |

*Primary Examiner*—Donald R. Schran

*Attorney, Agent, or Firm*—Kolisch, Hartwell & Dickinson

[57] ABSTRACT

An anti-kickback saw chain including a series of left and right cutter links disposed alternatively on opposite sides of the chain. A novel safety link disposed in front of each cutter link functions to prevent a cutter portion in the cutter link, when rounding the nose of a saw bar, from cutting deeply into the wood. The safety link includes a leading projection adjacent the forward end of the link and a trailing projection adjacent the rear end of the link, the leading and trailing projections being separated by a gullet intermediate the projections.

9 Claims, 3 Drawing Figures

ANTI-KICKBACK SAW CHAIN

BACKGROUND AND SUMMARY

The present invention relates to saw chains, and in particular, to an anti-kickback saw chain.

The usual type of chain saw has an elongate saw bar terminating at a rounded nose, and an endless saw chain which is driven in a grooved track about the periphery of the bar. The saw chain is composed of a series of center links which are pivotally joined by a series of side links and by a series of left and right cutter links disposed alternately on opposite sides of the chain at regular intervals therealong. Each cutter link has a cutter blade with a forward cutting edge and a depth gauge disposed forwardly of the cutter blade and extending somewhat below the height of the cutter edge, to produce a desired depth of cut, or depth of bite, of each cutter blade into the workpiece.

A safety hazard associated with the use of chain saws is what is commonly referred to as kickback. This refers to the tendency of a cutter portion in a cutter link of a saw chain to dig into the wood as the cutter link moves over the upper quadrant of the nose of a saw bar. When this occurs, and with movement of the cutter link abruptly stopped or seriously impeded, reaction forces produced tend to force the bar of the chain saw upwardly and rearwardly into the face of the operator.

A number of saw chains designed to prevent the problem of kickback are disclosed in the prior art. Many of the known anti-kickback chains employ safety links which are placed in the chains at positions preceeding the chain cutter links. Each safety link has an upstanding tang or cam portion which extends radially outwardly when the safety link is traversing a rounded saw bar nose to reduce the effective depth gauge setting for the trailing cutter link.

One general object of the present invention is to provide a novel safety link which, when incorporated into a conventional saw chain, produces an anti-kickback chain having several advantages not found in prior art anti-kickback saw chains.

More specifically, it is an object of the invention to provide such a safety link having leading and trailing projections which cooperate in a saw chain to eliminate kickback.

Another object of the invention is to provide such a safety link having projections which are easily filed in a saw chain filing operation.

Yet another object of the invention is to provide such a safety link which is relatively lightweight.

Providing an anti-kickback saw chain employing such a safety link is still another object of the present invention.

An anti-kickback saw chain constructed according to the present invention includes a series of left and right cutter links disposed alternately on opposite sides of the chain, and for each cutter link, a center link pivotally joined to the forward end of the cutter link and a safety link pivotally joined to the forward end of the center link on the side of the chain opposite the trailing cutter link. Each cutter link includes the usual depth gauge and cutter blade. The safety link includes a leading projection adjacent its forward end and a trailing projection adjacent its rear end, the leading and trailing projections being separated by a gullet disposed intermediate the projections.

In a straight portion of the chain, the leading and trailing projections extend substantially no higher than the depth gauge in the trailing cutter link, and the trailing projection also projects rearwardly to overlap the depth gauge laterally. The leading projection in the safety link projects upwardly in the chain substantially no higher than the rear end of the cutter blade in the cutter link which is immediately in advance of the safety link. In a portion of the chain traversing the rounded nose of a saw bar, the safety link pivots outwardly to a position where the trailing projection extends above the height of the depth gauge in the trailing cutter link, to reduce the effective depth gauge setting in that link.

These and other objects and features of the present invention will become more fully apparent when the following detailed description of a preferred embodiment of the invention is read in connection with the accompanying drawings.

DETAILED DESCRIPTION OF A PREFERRED EMBODIMENT OF THE INVENTION

Figures 1, 2, 3:
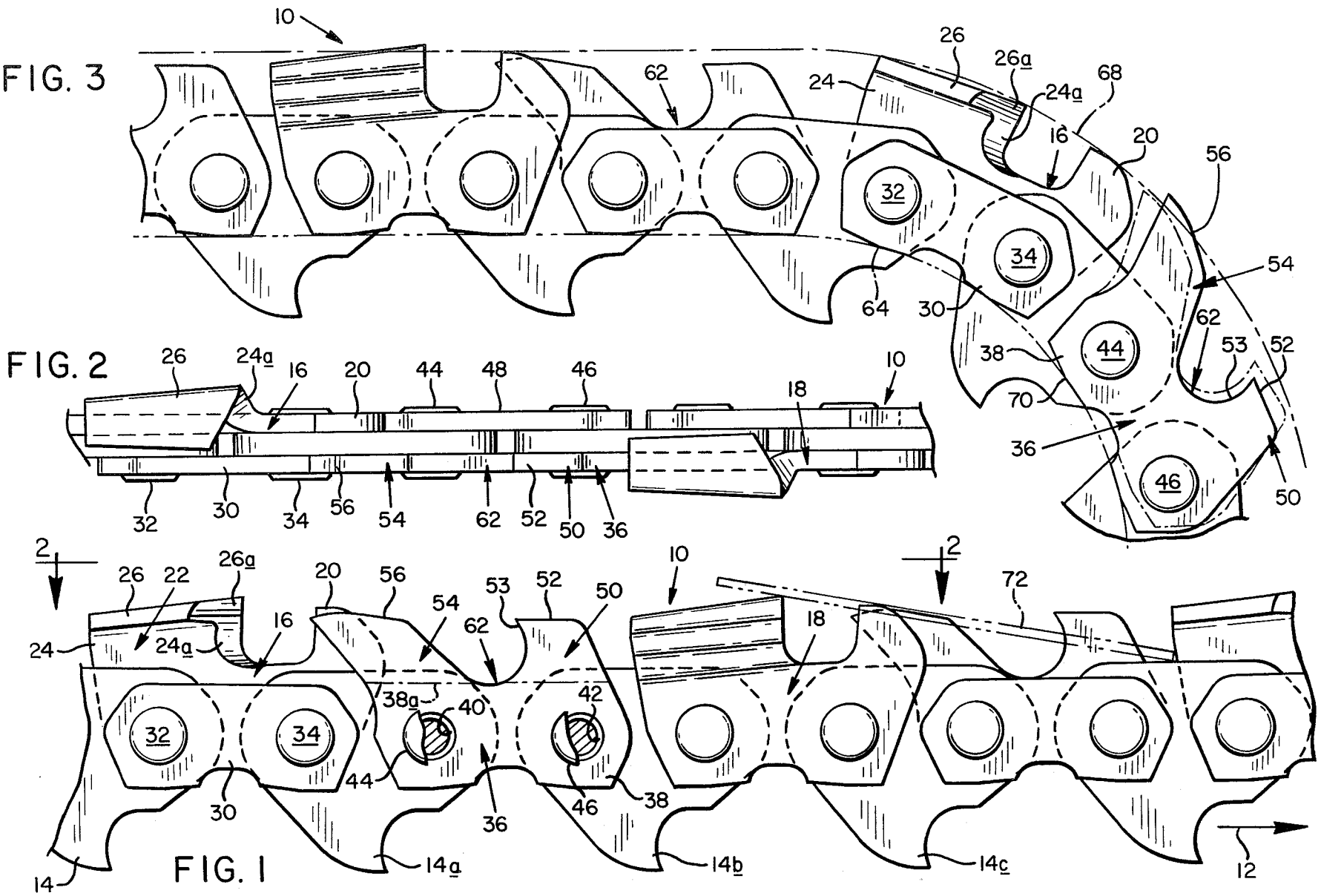
FIG. 1 is a side view of a straight portion of an anti-kickback saw chain constructed according to the present invention.
FIG. 2 is a top view of the chain shown in FIG. 1, taken generally along line 2—2 therein.
FIG. 3 is a fragmentary side view of a portion of the chain of the invention shown in an operative position traversing the rounded nose of a saw bar.

FIGS. 1 and 2 show in side and top views, respectively, a fragmentary portion of an anti-kickback saw chain 10 constructed according to the present invention. Chain 10 is intended for use on the conventional chain saw having an elongate bar which defines a peripheral groove in which the chain rides. The portion of the chain seen in FIGS. 1 and 2 extends substantially in a straight line such as occurs in a section of chain traversing the top or bottom, substantially parallel edges in such a saw bar. The direction of travel of the chain in a chain saw is indicated by arrow 12 in FIG. 1.

Chain 10 is formed by a series of center drive links, such as links 14, **14*a*, 14*b* and 14*c*. These links have sprocket-engaging projections by which the chain is driven around a saw bar by a power-driven sprocket wheel in a chain saw. Regularly spaced pairs of the center links are pivotally joined by left and right cutter links disposed alternately on opposite sides of the chain. This is illustrated in FIGS. 1 and 2, where a left cutter link 16 pivotally joins the pair of center links 14, 14*a* on the left side of the chain (the side away from the reader in FIG. 1 and the upper side in FIG. 2) and a right cutter link 18 pivotally joins the pair of cutter links 14*b*, 14*c*** on the right side of the chain.

Cutter link 16, which is representative, has an upwardly projecting depth gauge 20 adjacent the link's forward end, and a cutter, or cutter portion, 22 (FIG. 1) which trails the depth gauge in the chain. Cutter 22 is formed of an upwardly extending side blade 24 and a top blade 26, seen particularly in FIG. 2. The leading edge of the side blade is sharpened to form a side cutter edge **24*a* extending outwardly from the side of the chain, as seen in FIG. 2, and the leading edge of top blade 26 is sharpened to form a upper cutting edge 26*a* which extends upwardly above the height of the top of depth gauge 20, as can be seen in FIG. 1. Top plate 26** inclines downwardly on progressing rearwardly away from edge 26*a*, as seen in FIG. 1. The vertical spacing between the top of the depth gauge and the top of edge 26*a*, known as clearance, determines the effective depth of cut, or depth of bite, of the chain, with such traveling in a straight line. Typically the depth gauges in a saw chain are ground to produce a uniform clearance of between 25 and 40 mills. The cutter links incorporated in chain 10 are representative of chisel-type cutter links having a ⅜ inch pitch. It is understood that the chain of the invention may employ chipper-type cutter links and links having other pitch sizes.

Each cutter link, and an associated side link disposed on the other side of the chain are pivotally joined to the associated pair of drive links by forward and rear rivets extending through suitable bores in the cutter link, drive links and side link. To illustrate, cutter link 16 and an associated side link 30 are pivotally joined to drive links 14, 14*a* by rear and forward rivets 32, 34, respectively. Portions of the chain 10 which have been described hereabove are conventional.

Chain 10 further includes, for each cutter link, such as link 16, a novel safety link, such as link 36, which immediately precedes the associated cutter link in the chain and is disposed on the side of the chain opposite that of the associated cutter link. Link 36, which is representative, may be thought of as having a body portion 38 (the portion below the dash-dot line 38*a* in FIG. 1) which corresponds, in side profile, roughly to the side profile of a side link, such as link 30. A rear bore 40 and a forward bore 42 (FIG. 1) formed in the link's body portion, adjacent the rear and forward ends of the link, respectively, have a center-to-center spacing of about 0.395 inch in a chain, such as chain 10, having a ⅜ inch pitch. The bores each have a diameter of about 0.125 inch. The bores receive rivets 44, 46 pivotally joining the safety link and a side link 48 on the other side of the chain to center links 14*a*, 14*b* in the chain.

A leading projection 50 formed integrally with body portion 38, at the forward end thereof, projects upwardly from the chain, as seen in FIG. 1. The projection has an upper edge 52 which extends along the forward portion of the safety link, substantially paralleling the line between the center of bores 40, 42. In a straight portion of the chain, as illustrated in FIG. 1, edge 52 extends substantially no higher than depth gauge 20 in the immediately trailing cutter link 16, and substantially no higher than the rear portion of the top blade in the cutter link immediately in advance of link 36 (cutter link 18). The rear surface of projection 50 is contoured to form a concave edge 53 (FIG. 1).

A trailing projection 54 in link 36 is integrally formed with body portion 38 adjacent the rear end thereof. In a straight section of the chain, such as illustrated in FIG. 1, the trailing edge extends rearwardly a distance of about 0.17 inch beyond the rear of body portion 38 to overlap the depth gauge in immediately trailing cutter link 16, as shown. The trailing projection is contoured along its top surface by a convex edge 56 which extends from the projection's left rear end point in FIG. 1 downwardly toward the top surface of body portion 38, substantially midway therealong. Edges 56, 53 define a gullet 62 whose base is located approximately midway between the front and rear ends of the body portion of link 36.

FIG. 3 shows the configuration of a portion of chain 10—and in particular, a portion of the chain shown in FIG. 1 and 2—as the same traverses the rounded nose of a conventional saw bar, indicated here by dashed-double-dot line 64. The particular configuration of the chain shown in FIG. 3 is that which results when a chain having the described ⅜ inch pitch traverses a nose bar having a 15/16 inch radius. As seen in this figure, a safety link, such as link 36, and a cutter link, such as link 16 which it precedes, pivot outwardly, away from one another, in traversing the bar's rounded nose. With link 16 in its outwardly pivoted position, the link's upper cutting edge 26*a* has a radial sweep indicated by dashed-dot line 68. The outward pivoting of link 36 places the rearwardly extending point of the link's trailing projection at position where its radial sweep is substantially greater than that represented by line 68. The trailing edge in this configuration thus acts to keep the upper cutting edge in the immediate preceding cutter from biting into the workpiece which the nose end of the saw contacts.

It can be appreciated in FIG. 3 that contact between the end of the saw bar and the workpiece, with the application of force against the workpiece, will produce pivoting of the safety link traversing the saw bar's nose about a point corresponding approximately to point 70 in link 36, substantially directly below the center of the rear bore in the safety link. Such pivoting carries the safety link from its position shown in solid lines in FIG. 3 toward that shown in dotted lines in the figure, where edge 52 in projection 50 and the rearward portion of edge 56 in projection 54 are disposed substantially along line 68. With the safety link thus pivoted, the force applied to the saw nose and against a workpiece is distributed along edges 52, 56 and the upper edge in the depth gauge in the trailing cutter link, to minimize penetration of the cutter link depth gauge into the workpiece.

Advantages of the saw chain employing the safety link of the present invention will now be considered. In a straight-line portion of the chain, the leading and trailing projections in the chain's safety links extend substantially no higher than the depth gauges in the chain's cutter links, permitting normal cutting action. In a portion of the chain taversing the rounded nose of a saw bar, each safety link pivots outwardly away from the immediately trailing cutter link to position the safety link's trailing portion substantially above the radial sweep line of the upper cutting edge in the trailing cutter link. In this configuration, the trailing projection acts to fend off the workpiece against which the saw bar is applied, to keep the nose at a position where the upper cutter blade in the trailing cutter link is not biting into the workpiece.

With the application of increased force of the saw bar against the workpiece, the safety link is pivoted toward a position where contact between the substantially flat, longitudinally extending surfaces of the leading and trailing edges in the safety link act to prevent penetration of the saw chain into the workpiece to a depth where significant depth of cutting can occur. When the chain saw is used for sawing or boring at the nose end of the saw bar, this reduced depth of cutting reduces the tendency of the bar to kick back.

Another advantageous feature of the present invention is related to the fact that the trailing projection in a safety link may be readily filed down in a routine depth gauge grinding operation. Following a typical blade cutter sharpening operation, in which the height of each cutter blade is reduced somewhat, it is usual to grind the associated depth gauges to establish the desired chain clearance. Such depth gauge grinding is performed, according to one common practice, by placing a file template—which is shown in side view by dashed-double dot lines 72 in FIG. 1—over a straight portion of the chain as shown. The depth gauge and the two projections in the preceding safety link are received through slots in the template. Those portions of the depth gauge and the trailing projection projecting above the upper surface of the template are then filed down to achieve the proper degree of grinding in the depth gauge and adjacent trailing projection. The gullet in the safety link delineates that portion of the safety link which should be filed adjacent the rear of the link, and that portion (projection 50) at the front of the link which should be left without filing. It is noted that grinding of the trailing projection above template 72 will not reduce the extent of radial projection of the trailing projection in a portion of the chain traversing the rounded nose in the saw bar.

The gullet in the safety link of the invention also allows the link to be constructed as a relatively lightweight article. The lesser weight of the link contributes to the overall performance of the saw chain.

While a preferred embodiment of the invention as been described herein, it will be apparent to those skilled in the art that various changes and modifications can be made without departing from the spirit of the invention.

It is claimed and desired to secure by Letters Patent:

1. A saw chain comprising:

a series of left and right hand cutter links disposed alternately on opposite sides of the chain, and other links pivotally connected to each other and to the cutter links to complete the chain, each cutter link including an upwardly projecting depth gauge adjacent the forward end of the link and a cutter portion including a top blade trailing the depth gauge, the cutter portion having a forward cutting edge extending above the height of the depth gauge, the top blade of the cutter portion inclining downwardly progressing rearwardly in the cutter link, said other links including a center link for each cutter link pivotally connected adjacent its rear end to the forward end of the cutter link and a safety link for each cutter link pivotally connected adjacent its rear end to the center link and on the opposite side of the chain from the cutter link, the safety link including a leading projection adjacent the forward end of the link and a trailing projection adjacent the rear end of the link, said leading and trailing projections being separated by a gullet disposed intermediate the projections, the leading projection and the trailing projection, with the chain extending in a straight line, projecting upwardly from the chain no higher than the depth gauge but at least a major portion of the height of the depth gauge, said trailing projection also projecting rearwardly to overlap the depth gauge.

2. The saw chain of claim 1, wherein the leading projection in the safety link projects upwardly in the chain no higher than the height of the rear end of the top blade in the cutter link which is immediately in advance of the safety link.

3. The saw chain of claim 1, wherein the gullet separating the leading and trailing projections in the safety link has a base located at substantially the top of a body portion in the safety link, said base being substantially midway between the forward and rear ends of said body portion.

4. The saw chain of the claim 1, wherein the gullet separating the leading and trailing projections in the safety link has a base located at substantially the top of a body portion in the safety link, said base being substantially midway between the forward and rear ends of said body portion, and said trailing projection is contoured along the top thereof by a convex edge which extends from a region adjacent the base of said gullet and slopes upwardly and rearwardly progressing from this region to another region located adjacent the rear end of the trailing projection.

5. The saw chain of claim 1, wherein the leading projection in the safety link projects upwardly in the chain no higher than the height of the rear end of the top blade in the cutter link which is immediately in advance of the safety link, the leading projection is contoured along the top thereof by a substantially straight edge which parallels the longitudinal axis of the link, the gullet separating the leading and trailing projections in the link has a base located at substantially the top of a body portion in the safety link, said base being substantially midway between the forward and rear ends of said body portion, and said trailing projection is contoured along the top thereof by a convex edge which extends from a region adjacent the base of said gullet and slopes upwardly and rearwardly progressing from its region to another region located adjacent the rear end of the trailing projection.

6. A safety link for a saw chain comprising:

an elongate planar body portion and a bore adjacent the forward end and another bore adjacent the rear end of said body portion adapted to receive rivets holding the link in a chain, a planar leading projection integral with and in the plane of said body portion extending upwardly from adjacent the forward end of the body portion, said leading projection being contoured along the top thereof by an upper edge which substantially parallels a line extending through the centers of said bores and at least a portion of said upper edge overlying the bore provided at the forward end of the link, a planar trailing projection integral with and in the plane of the body portion of the link extending unpwardly from the body portion and rearwardly from the body portion, a gullet separating said leading and trailing projections with the base of said gullet located adjacent the top of the body portion in the link, said trailing projection being contoured by a convex blunt edge which extends from a region adjacent the base of the gullet and slopes upwardly and rearwardly progressing from this region to another region located adjacent the rear end of the trailing projection.

7. The link of claim 6, wherein the gullet has a base which is located substantially midway between the centers of said bores.

8. The link of claim 7, wherein the trailing projection projects rearwardly of said body portion a distance which is at least a major portion of the diameter of a bore and projects upwardly from the body portion a distance which is at least equal to the height of the leading projection.

9. A saw chain comprising:

a series of cutter links disposed along the length of the chain, and other links pivotally connected to each other and to the cutter links to complete the chain, each cutter link including an upwardly projecting depth gauge adjacent the forward end of the link and a cutter portion including a top blade trailing the depth gauge, the cutter portion having a forward cutting edge extending above the height of the depth gauge, the top blade of the cutter portion inclining downwardly progressing rearwardly in the cutter link, said other links including a safety link for each cutter link preceding the cutter link, the safety link including an elongate body portion extending along the base of the link, a leading projection integral with said body portion extending upwardly from adjacent the forward end of the body portion, and a trailing projection integral with the body portion of the link extending upwardly from the body portion and rearwardly from the body portion, said leading and trailing projections being separated by a gullet disposed intermediate the projections and said gullet having a base located directly adjacent the top of said body portion, the leading projection and the trailing projection, with the chain extending in a straight line, projecting upwardly from the body portion of the safety link no higher than the depth gauge but at least a major portion of the height of the depth gauge, said leading projection being contoured along the top thereof by an edge which substantially parallels the longitudinal axis of the body portion in the safety link, said trailing projection being contoured by a convex edge which extends from a region adjacent the base of the gullet and slopes upwardly and rearwardly progressing from this region to another region located adjacent the rear end of the trailing projection.

* * * * *